US008492964B2

(12) United States Patent
Nakamura et al.

(10) Patent No.: US 8,492,964 B2
(45) Date of Patent: Jul. 23, 2013

(54) SPARK PLUG AND MANUFACTURING METHOD THEREOF

(75) Inventors: Mai Nakamura, Aichi (JP); Akira Suzuki, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 222 days.

(21) Appl. No.: 13/158,094

(22) Filed: Jun. 10, 2011

(65) Prior Publication Data

US 2011/0304256 A1 Dec. 15, 2011

(30) Foreign Application Priority Data

Jun. 11, 2010 (JP) ..... 2010-133775
Apr. 20, 2011 (JP) ..... 2011-093977

(51) Int. Cl.
*H01T 13/20* (2006.01)
*H01T 13/00* (2006.01)

(52) U.S. Cl.
USPC ..... 313/141; 313/144; 313/145; 445/7

(58) Field of Classification Search
None
See application file for complete search history.

(56) References Cited

U.S. PATENT DOCUMENTS 6,849,995 B2 * 2/2005 Suzuki ..... 313/143
8,033,880 B2 * 10/2011 Suzuki et al. ..... 445/7

FOREIGN PATENT DOCUMENTS

JP 2003-257583 A 9/2003

* cited by examiner

*Primary Examiner* — Britt D Hanley
(74) *Attorney, Agent, or Firm* — Sughrue Mion, PLLC

(57) ABSTRACT

A spark plug including a center electrode; an insulator; and a metal shell, the metal shell including: a tool engaging section; a body section; and a groove section formed between the tool engaging section and the body section, and having bulges which bulge in an outer peripheral direction and in an inner peripheral direction. When a portion of the groove section having a largest outer diameter is a first section, a thinnest portion from the first section to the body section is a second section, and a portion having a thickness that is the same as that of the first section is a third section, a relation between a thickness A of the second section and a radius of curvature R of an outer surface of the metal shell that continues from the second section to the third section satisfies $R \times A \geqq 0.20\ mm^2$.

11 Claims, 19 Drawing Sheets

FIG. 5A

| RADIUS OF CURVATURE R [mm] | 0.10 | 0.20 | 0.30 | 0.35 | 0.50 | 0.40 | 0.60 |
|---|---|---|---|---|---|---|---|
| R × A [mm²] (THICKNESS A=0.5) | 0.05 | 0.10 | 0.15 | 0.18 | 0.20 | 0.25 | 0.30 |
| PRESENCE OR ABSENCE OF CRACK | PRE-SENT | PRE-SENT | PRE-SENT | PRE-SENT | ABSENT | ABSENT | ABSENT |

FIG. 5B

| RADIUS OF CURVATURE R [mm] | 0.10 | 0.20 | 0.30 | 0.35 | 0.50 | 0.40 | 0.60 |
|---|---|---|---|---|---|---|---|
| R × A [$mm^2$] (THICKNESS A=0.6) | 0.06 | 0.12 | 0.18 | 0.21 | 0.24 | 0.30 | 0.36 |
| PRESENCE OR ABSENCE OF CRACK | PRE-SENT | PRE-SENT | PRE-SENT | ABSENT | ABSENT | ABSENT | ABSENT |

FIG. 5C

| RADIUS OF CURVATURE R [mm] | 0.10 | 0.20 | 0.25 | 0.30 | 0.50 | 0.40 | 0.60 |
|---|---|---|---|---|---|---|---|
| R × A [mm²] (THICKNESS A=0.7) | 0.07 | 0.14 | 0.18 | 0.21 | 0.28 | 0.35 | 0.42 |
| PRESENCE OR ABSENCE OF CRACK | PRE-SENT | PRE-SENT | PRE-SENT | ABSENT | ABSENT | ABSENT | ABSENT |

FIG. 5D

| RADIUS OF CURVATURE R [mm] | 0.10 | 0.20 | 0.25 | 0.30 | 0.50 | 0.40 | 0.60 |
|---|---|---|---|---|---|---|---|
| R × A [mm²] (THICKNESS A=0.8) | 0.08 | 0.16 | 0.20 | 0.24 | 0.32 | 0.40 | 0.48 |
| PRESENCE OR ABSENCE OF CRACK | PRE-SENT | PRE-SENT | ABSENT | ABSENT | ABSENT | ABSENT | ABSENT |

| A/B | 0.4 | 0.5 | 0.6 | 0.7 | 0.8 | 0.9 | 1.0 | 1.1 | 1.2 | 1.3 |
|---|---|---|---|---|---|---|---|---|---|---|
| PRESENCE OR ABSENCE OF CRACK (60 MINUTES) | ABSENT | ABSENT | ABSENT | ABSENT | ABSENT | ABSENT | ABSENT | ABSENT | ABSENT | ABSENT |
| PRESENCE OR ABSENCE OF CRACK (120 MINUTES) | PRE-SENT | PRE-SENT | ABSENT | ABSENT | ABSENT | ABSENT | ABSENT | PRE-SENT | PRE-SENT | PRE-SENT |
| PORTION OF GENERATION OF CRACK |  | |   | | | | |  | | |

| HARDNESS DIFFERENCE ΔHv INSIDE GROOVE SECTION | 70 | 80 | 90 | 100 | 110 | 120 | 130 |
|---|---|---|---|---|---|---|---|
| 「R×A=0.10,A/B=0.40」 ENDURANCE TIME (MINUTE) OF SAMPLE OF | 60 | 55 | 55 | 20 | 15 | 15 | 10 |
| 「R×A=0.40,A/B=0.70」 ENDURANCE TIME (MINUTE) OF SAMPLE OF | 120 OR MORE | 120 OR MORE | 120 OR MORE | 120 OR MORE | 120 OR MORE | 120 OR MORE | 120 OR MORE |
| IMPROVING RATE OF STRENGTH | 2.0 | 2.2 | 2.2 | 6.0 | 8.0 | 8.0 | 12.0 |

| SECTION MODULUS Z1 OF OUTERMOST SECTION [$mm^3$] | 150 | 160 | 170 | 180 | 190 | 200 | 210 |
|---|---|---|---|---|---|---|---|
| 「R×A=0.10,A/B=0.40」「ΔHv=100」 ENDURANCE TIME (MINUTE) OF SAMPLE OF | 5 | 6 | 9 | 30 | 45 | 50 | 55 |
| 「R×A=0.40,A/B=0.70」「ΔHv=100」 ENDURANCE TIME (MINUTE) OF SAMPLE OF | 120 OR MORE | 120 OR MORE | 120 OR MORE | 120 OR MORE | 120 OR MORE | 120 OR MORE | 120 OR MORE |
| IMPROVING RATE OF STRENGTH | 24.0 | 20.0 | 13.3 | 4.0 | 2.7 | 2.4 | 2.2 |

IMPROVING RATE OF STRENGTH (SHOWN IN GRAPH)

| SECTION MODULUS Z1 OF OUTERMOST SECTION [$mm^3$] | 150 | 160 | 170 | 180 | 190 | 200 | 210 |
|---|---|---|---|---|---|---|---|
| 「R×A=0.10,A/B=0.40」「ΔHv=200」 ENDURANCE TIME (MINUTE) OF SAMPLE OF | 5 | 10 | 13 | 50 | 55 | 58 | 60 |
| 「R×A=0.40,A/B=0.70」「ΔHv=200」 ENDURANCE TIME (MINUTE) OF SAMPLE OF | 120 OR MORE | 120 OR MORE | 120 OR MORE | 120 OR MORE | 120 OR MORE | 120 OR MORE | 120 OR MORE |
| IMPROVING RATE OF STRENGTH | 24.0 | 12.0 | 9.2 | 2.4 | 2.2 | 2.1 | 2.0 |

IMPROVING RATE OF STRENGTH (SHOWN IN GRAPH)

| SECTION MODULUS Z1 OF OUTERMOST SECTION [mm³] | 150 | 160 | 170 | 180 | 190 | 200 | 210 |
|---|---|---|---|---|---|---|---|
| 「R×A=0.10,A/B=0.40」「ΔHv=300」 ENDURANCE TIME (MINUTE) OF SAMPLE OF | 12 | 15 | 20 | 70 | 80 | 80 | 85 |
| 「R×A=0.40,A/B=0.70」「ΔHv=300」 ENDURANCE TIME (MINUTE) OF SAMPLE OF | 120 OR MORE | 120 OR MORE | 120 OR MORE | 120 OR MORE | 120 OR MORE | 120 OR MORE | 120 OR MORE |
| IMPROVING RATE OF STRENGTH | 10.0 | 8.0 | 6.0 | 1.7 | 1.5 | 1.5 | 1.4 |

| SECTION MODULUS Z2 OF INFLECTION SECTION [mm³] | 50 | 60 | 70 | 80 | 90 | 100 | 110 | 120 |
|---|---|---|---|---|---|---|---|---|
| 「R×A=0.10」 ENDURANCE TIME (MINUTE) OF SAMPLE OF | 5 | 5.5 | 8 | 10 | 35 | 40 | 40 | 45 |
| 「R×A=0.20」 ENDURANCE TIME (MINUTE) OF SAMPLE OF | 120 OR MORE | 120 OR MORE | 120 OR MORE | 120 OR MORE | 120 OR MORE | 120 OR MORE | 120 OR MORE | 120 OR MORE |
| IMPROVING RATE OF STRENGTH | 24.0 | 21.8 | 15.0 | 12.0 | 3.4 | 3.0 | 3.0 | 2.7 |

FIG. 12

| D/C | 0.3 | 0.4 | 0.5 | 0.6 | 0.7 | 0.8 | 0.9 | 1.0 |
|---|---|---|---|---|---|---|---|---|
| PRESENCE OR ABSENCE OF LEAKAGE | PRE-SENT | PRE-SENT | ABSENT | ABSENT | ABSENT | ABSENT | ABSENT | ABSENT |

FIG. 13

| L3/L1 \ L2/L1 | 0.1 | 0.2 | 0.3 | 0.4 | 0.5 |
|---|---|---|---|---|---|
| 0.1 | PRESENT | PRESENT | PRESENT | PRESENT | PRESENT |
| 0.2 | PRESENT | ABSENT | ABSENT | ABSENT | ABSENT |
| 0.3 | PRESENT | ABSENT | ABSENT | ABSENT | ABSENT |
| 0.4 | PRESENT | ABSENT | ABSENT | ABSENT | ABSENT |
| 0.5 | PRESENT | ABSENT | ABSENT | ABSENT | ABSENT |

SPARK PLUG AND MANUFACTURING METHOD THEREOF

BACKGROUND OF THE INVENTION

1. Field of the Invention

The present invention relates to a spark plug (an ignition plug) that ignites fuel by generating an electric spark in an internal combustion engine.

2. Description of the Related Art

A spark plug is known in which a metal shell is fixed by heat crimping at the outer periphery of an insulator that holds a center electrode (see, for example, JP-A-2003-257583). In the heat crimping, the metal shell in which the insulator is inserted is heated and in this state, the metal shell is plastically deformed by a compression load so that the metal shell is fixed to the insulator. Generally, the metal shell of the spark plug includes a polygonal-shape tool engaging section that engages with a tool to attach the spark plug to an engine head and a body section that compresses a gasket toward the engine head. A groove section that bulges to the outer peripheral direction and the inner peripheral direction by the heat crimping is formed between the tool engaging section and the body section of the metal shell that is heat crimped to the insulator.

[Patent Document]

JP-A-2003-257583

3. Problem to be Solved by the Invention

In recent years, as one of various solutions to improve fuel consumption or decrease the exhaust gas of an internal combustion engine, a reduction in spark plug diameter has been investigated. However, a decrease in the strength of the metal shell is not sufficiently taken into consideration in relation to miniaturization of the spark plug. For example, at a portion in which the thickness in the radial direction from the groove section through the body section at the metal shell is thinned, the breaking strength is lowered according to the lowering of hardness through the influence of heat at the time of heat crimping. Thus, there is a problem in that when the metal shell is miniaturized at a reduction ratio in its present format, the breaking strength of the groove section at the metal shell is not capable of being sufficiently secured and a crack may generate at the groove section.

SUMMARY OF THE INVENTION

It is therefore an object of the present invention to provide a spark plug in which the breaking strength of the metal shell is improved in light of the above-described problem.

The invention has been made to address the above-described problem, and has been realized in the embodiments and applications described below.

[Application 1] A spark plug including: a rod-shaped center electrode extending in an axial direction; an insulator provided at the outer periphery of the center electrode; and a metal shell provided at the outer periphery of the insulator, the metal shell including: a tool engaging section extending in an outer peripheral direction, wherein a cross-section of the tool engaging section crossing at right angles to the axial direction has a polygonal-shape; a body section extending in the outer peripheral direction; and a groove section formed between the tool engaging section and the body section, and having bulges which bulge in the outer peripheral direction and an inner peripheral direction, wherein, when a portion of the groove section having a largest outer diameter is a first section, a thinnest portion of the groove section in the radial direction from the first section to the body section is a second section, and a portion of the groove section having a thickness the same as the first section in the radial direction at the body section is a third section, a relation between thickness A of the second section in the radial direction at the cross-section including the axis direction and a radius of curvature R of the outer surface of the metal shell that continues from the second section to the third section satisfies $R \times A \geqq 0.20\ mm^2$. According to the spark plug of application 1, the breaking strength of the groove section of the metal shell is capable of being improved.

[Application 2] The spark plug according to application 1, wherein a Vickers hardness of the second section of the groove section is lower than a Vickers hardness of the body section by 10% or more. According to the spark plug of application 2, the breaking strength of the groove section is capable of being sufficiently secured, even for a metal shell in which a Vickers hardness of the groove section is lower than a Vickers hardness of the body section by 10% or more.

[Application 3] The spark plug according to application 1 or 2, wherein a section modulus Z2 of the second section is $Z2 \leqq 80\ mm^3$. According to the spark plug of application 3, since the section modulus Z2 of the second section is relatively small and a compact size is promoted, the breaking strength of the groove section at the metal shell is capable of being sufficiently secured.

[Application 4] The spark plug according to any one of applications 1 to 3, wherein the section modulus Z2 of the second section is $Z2 \leqq 60\ mm^3$. According to the spark plug of application 4, since the section modulus Z2 of the second section is relatively small and a compact size is promoted, the breaking strength of the groove section at the metal shell is capable being further sufficiently secured.

[Application 5] The spark plug according to any one of applications 1 to 4, wherein when the thickness of the first section in the radial direction is B, $0.6 \leqq (A/B) \leqq 1.0$ is satisfied. According to the spark plug of application 5, the stress concentration at the groove section of the metal shell is suppressed, and the breaking strength of the groove section is capable of further improvement.

[Application 6] The spark plug according to any one of applications 1 to 5, wherein a hardness difference $\Delta Hv$ between the maximum value and the minimum value of a Vickers hardness over a range from the first section to the second section is $\Delta Hv \geqq 100$. According to the spark plug of application 6, the breaking strength of the groove section is capable of being sufficiently secured even for a metal shell in which distortion is generated at the groove section due to the hardness difference by being subjected to heat crimping.

[Application 7] The spark plug according to any one of applications 1 to 6, wherein the section modulus Z1 of the first section is $Z1 \leqq 170\ mm^3$. According to the spark plug of application 7, since the section modulus Z1 of the first section is relatively small and a compact size is promoted, the breaking strength of the groove section of the metal shell is capable of being sufficiently secured.

[Application 8] The spark plug according to any one of applications 1 to 7, wherein $0.5\ mm \leqq A \leqq 0.6\ mm$. According to the spark plug of application 8, since the thickness A of the second section in the radial direction is relatively thin and a compact size is promoted, the breaking strength of the groove section of the metal shell is capable of being sufficiently secured.

[Application 9] A method of manufacturing a spark plug including: a rod-shaped center electrode extending in an axial direction, an insulator provided at the outer periphery of the center electrode, and a metal shell provided at the outer periphery of the insulator, the metal shell including: a tool engaging section extending in an outer peripheral direction, wherein a cross-section of the tool engaging section crossing at right angles to the axial direction has a polygonal-shape, a body section extending in the outer peripheral direction, and a groove section formed between the tool engaging section and the body section, and having bulges which bulge in the outer peripheral direction and in an inner peripheral direction, the method comprising: forming the groove section in a shape having a thickness that is thinned continuously from the tool engaging section and the body section to the center of the groove section in the radial direction before forming the bulges between the tool engaging section and the body section, prior to assembling the metal shell to the insulator, and then bulging the groove section in the outer peripheral direction and in the inner peripheral direction when the metal shell is joined to the insulator through heat crimping. According to the manufacturing method of application 9, a spark plug can be manufactured, in which the groove section can bulge in a smooth shape at the time of heat crimping such that the breaking strength of the groove section at the metal shell is improved.

[Application 10] The method according to application 9, wherein when a thickness that is 80% of the thinnest portion of the tool engaging section in the radial direction is C and the thickness in the radial direction of the center of the groove section before forming the bulges is D, the groove section before forming the bulges satisfies $0.5 \leqq (D/C) \leqq 1.0$. According to the manufacturing method of application 10, a spark plug can be manufactured, in which the breaking strength of the groove section of the metal shell is improved, while air tightness between the insulator and the metal shell also is improved.

[Application 11] The method according to application 10, wherein, when a distance along the axis direction from a fourth section where the thickness of the groove section before forming the bulges in the radial direction at the tool engaging section side is C, to a fifth section where a thickness of the groove section before forming the bulges in the radial direction at the body section side is C is L1, a distance along the axis direction between a sixth section where a thickness of the groove section before forming the bulges in the radial direction at the tool engaging section side is (0.8×C) and the fourth section is L2, and a distance along the axis direction between a seventh section where the thickness of the groove section before forming the bulges in the radial direction at the body section side is (0.8×C) and the fifth section is L3, and the groove section before forming the bulges satisfies $0.2 \leqq (L2/L1) \leqq 0.5$ and $0.2 \leqq (L3/L1) \leqq 0.5$. According to the manufacturing method of application 11, a spark plug can be manufactured, in which the breaking strength of the groove section of the metal shell is improved sufficiently.

The invention is not limited to the embodiment of a spark plug, and may be applied to various embodiments such as, for example, the metal shell of the spark plug, the internal combustion engine that includes the spark plug and a method of manufacturing the spark plug. Also, the invention is not limited to the above-described embodiments and various modifications can be made without departing from the spirit and scope of the invention.

BRIEF DESCRIPTION OF THE DRAWINGS

Illustrative aspects of the invention will be described in detail with reference to the following figures, wherein:

FIG. 5A is an explanatory drawing illustrating the results of an evaluation test that investigates the relation between a value of R×A and the impact resistance performance of the groove section when the thickness A of the inflection section is A=0.5 mm;

FIG. 5B is a explanatory drawing illustrating the results of an evaluation test that investigates the relation between the value of R×A and the impact resistance performance of the groove section when the thickness A of the inflection section is A=0.6 mm;

FIG. 5C is an explanatory drawing illustrating the results of an evaluation test that investigates the relation between the value of R×A and the impact resistance performance of the groove section when the thickness A of the inflection section is A=0.7 mm;

FIG. 5D is an explanatory drawing illustrating the results of an evaluation test that investigates the relation between the value of R×A and the impact resistance performance of the groove section when the thickness A of the inflection section is A=0.8 mm;

FIG. 12 is an explanatory drawing illustrating the results of an evaluation test that investigates the relation between the ratio D/C of the thickness and the air tightness performance of the groove section; and FIG. 13 is an explanatory drawing illustrating the results of an evaluation test that investigates the relation between the ratio (L2/L1) and (L3/L1) of the length at the groove section, and the impact resistance performance of the groove section.

DETAILED DESCRIPTION OF THE PREFERRED EMBODIMENTS

The invention will now be described in detail with reference to the drawings. However, the present invention should not be construed as being limited thereto.

A. Embodiment

A-1. Constitution of Spark Plug

Figure 1:
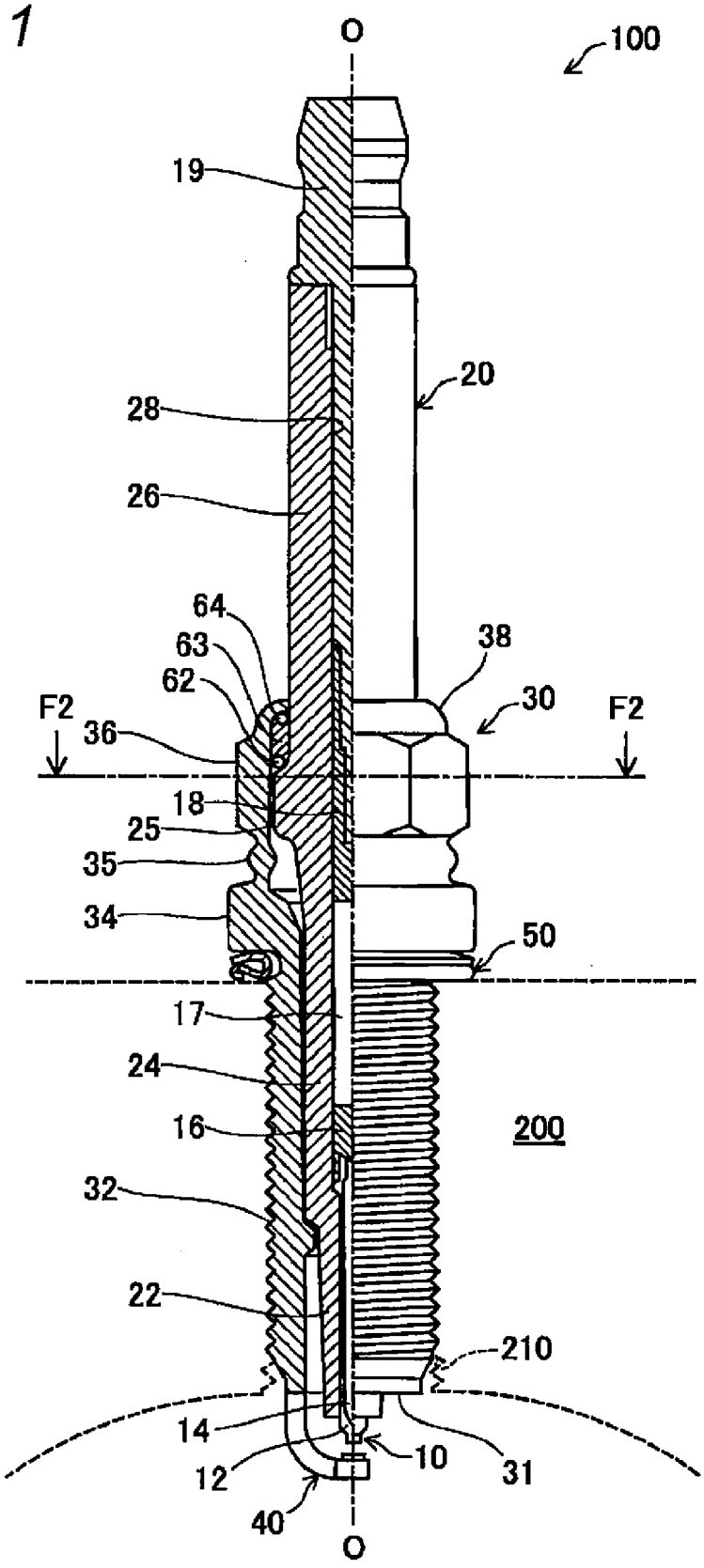
FIG. 1 is a sectional view partially illustrating a spark plug.

FIG. 1 is a sectional view partially illustrating a spark plug 100. In FIG. 1, the outer shape of the spark plug 100 is illustrated at one side and the cross-sectional shape of the spark plug 100 is illustrated at the other side with an axis O-O that is the axial center of the spark plug 100 as a border. The spark plug 100 includes a center electrode 10, an insulator 20, a metal shell 30 and a ground electrode 40. In the embodiment, the axis O-O of the spark plug 100 is also the axial center of each of members such as the center electrode 10, the insulator 20 and the metal shell 30.

In the spark plug 100, the outer periphery of the rod-shaped center electrode 10 that extends to the axis O-O is electrically insulated by the insulator 20. One end of the center electrode 10 projects from one end of the insulator 20 and the other end of the center electrode 10 is electrically connected to the other end of the insulator 20. At the outer periphery of the insulator 20, the metal shell 30 is fixed through heat crimping in a state where the metal shell 30 is in an electrically insulated state from the center electrode 10. The ground electrode 40 is electrically connected to the metal shell 30 and a spark gap where the spark is generated is formed between the center electrode 10 and the ground electrode 40. The spark plug 100 is attached to an engine head 200 of the internal combustion engine (not shown) in a state where the metal shell 30 is screwed into an attachment screw hole 210 that is formed in the engine head 200. When a high voltage of 20,000 to 30,000 volts is applied to the center electrode 10, a spark is generated at the spark gap that is formed between the center electrode 10 and the ground electrode 40.

The center electrode 10 of the spark plug 100 is a rod-shaped electrode that embeds a core material 14 having a thermal conductivity that is superior to that of an electrode base material 12, the center electrode being formed in the shape of a cylinder having a bottom. In the embodiment, the center electrode 10 is fixed to the insulator 20 in a state where the front end of the electrode base material 12 projects from one end of the insulator 20. Also, the center electrode 10 is electrically connected to the other end of the insulator 20 through a seal body 16, a ceramic resistance 17, a seal body 18 and a terminal metal fitting 19. In the embodiment, the electrode base material 12 of the center electrode 10 is formed of a nickel alloy having nickel as main component, such as INCONEL (registered trade mark), and the core material 14 of the center electrode 10 is formed of copper or a copper alloy having copper as a main component.

The ground electrode 40 of the spark plug 100 is joined to the metal shell 30 by welding, and is bent at right angles in the direction of the axis O-O of the center electrode 10 so as to face the front end of the center electrode 10. In the embodiment, the ground electrode 40 is formed of a nickel alloy having nickel as a main component, such as INCONEL (registered trade mark).

The insulator 20 of the spark plug 100 is formed by firing an insulated ceramic material including alumina. The insulator 20 is a cylindrical body having an axial hole 28 that accommodates the center electrode 10. The insulator 20 includes a leg section 22, a first insulator body section 24, an insulator flange section 25 and a second insulator body section 26, in this order from the projecting side of the center electrode 10 along the axis O-O. The leg section 22 of the insulator 20 is a cylindrical portion having an outer diameter which gradually decreases toward the projecting side of the center electrode 10. The first insulator body section 24 of the insulator 20 is a cylindrical portion having an outer diameter that is larger than that of the leg section 22. The insulator flange section 25 of the insulator 20 is a cylindrical portion having an outer diameter that is larger than that of the first insulator body section 24. The second insulator body section 26 of the insulator 20 is a cylindrical portion having an outer diameter that is smaller than that of the insulator flange section 25, and secures a sufficient insulating distance between the metal shell 30 and the terminal metal fitting 19.

In the embodiment, the metal shell 30 of the spark plug 100 is a member formed of low-carbon steel that is nickel plated. However, in other embodiments, the metal shell 30 may be a member formed of low-carbon steel that is zinc plated and may be a member formed of nickel alloy that is not plated. The metal shell 30 includes an end surface 31, an attachment screw section 32, a body section 34, a groove section 35, a tool engaging section 36 and a crimping section 38 in this order from the projecting side of the center electrode 10 along the axis O-O. The end surface 31 of the metal shell 30 is a hollow circular surface that is formed at the front end of the attachment screw section 32, the ground electrode 40 is joined at the end surface 31 and the center electrode 10 that is surrounded by the leg section 22 of the insulator 20 projects from the center of the end surface 31. The attachment screw section 32 of the metal shell 30 is a cylindrical portion having a thread that screws into the attachment screw hole 210 of the engine head 200 at the outer periphery thereof. The crimping section 38 of the metal shell 30 is provided adjacent the tool engaging section 36, and when the metal shell 30 is fixed through heat crimping to the insulator 20, the crimping section 38 is a portion where plastic working is performed so as to be closely attached to the second insulator body section 26 of the insulator 20. A filling section 63 in which talc powder is filled is formed in an area between the crimping section 38 of the metal shell 30 and the insulator flange section 25 of the insulator 20, and the filling section 63 is sealed by packings 62 and 64.

The groove section 35 of the metal shell 30 is formed between the body section 34 and the tool engaging section 36. When the metal shell 30 is fixed through heat crimping to the insulator 20, the groove section 35 is a portion that bulges in both the outer peripheral direction and the inner peripheral direction by compression working The body section 34 of the metal shell 30 is provided adjacent the groove section 35 and is a flange section that extends in the outer peripheral direction further than the groove section 35. The body section 34 compresses a gasket 50 toward the engine head 200. The tool engaging section 36 of the metal shell 30 is provided adjacent the groove section 35, and is the flange section that extends in the outer peripheral direction further than the groove section 35. The tool engaging section 36 is formed in a polygonal-shape that engages a tool (not shown) by which the spark plug 100 is attached to the engine head 200. In the embodiment, the tool engaging section 36 has a hexagonal shape. However, in other embodiments, it may be other polygonal-shapes such as a tetragonal shape and an octagonal shape. In the embodiment, the distance between sides facing each other at the tool engaging section 36 is 12 mm (millimeters). However, in other embodiments, it may be smaller than 12 mm, for example, 9 mm, 10 mm or 11 mm.

Figure 2:
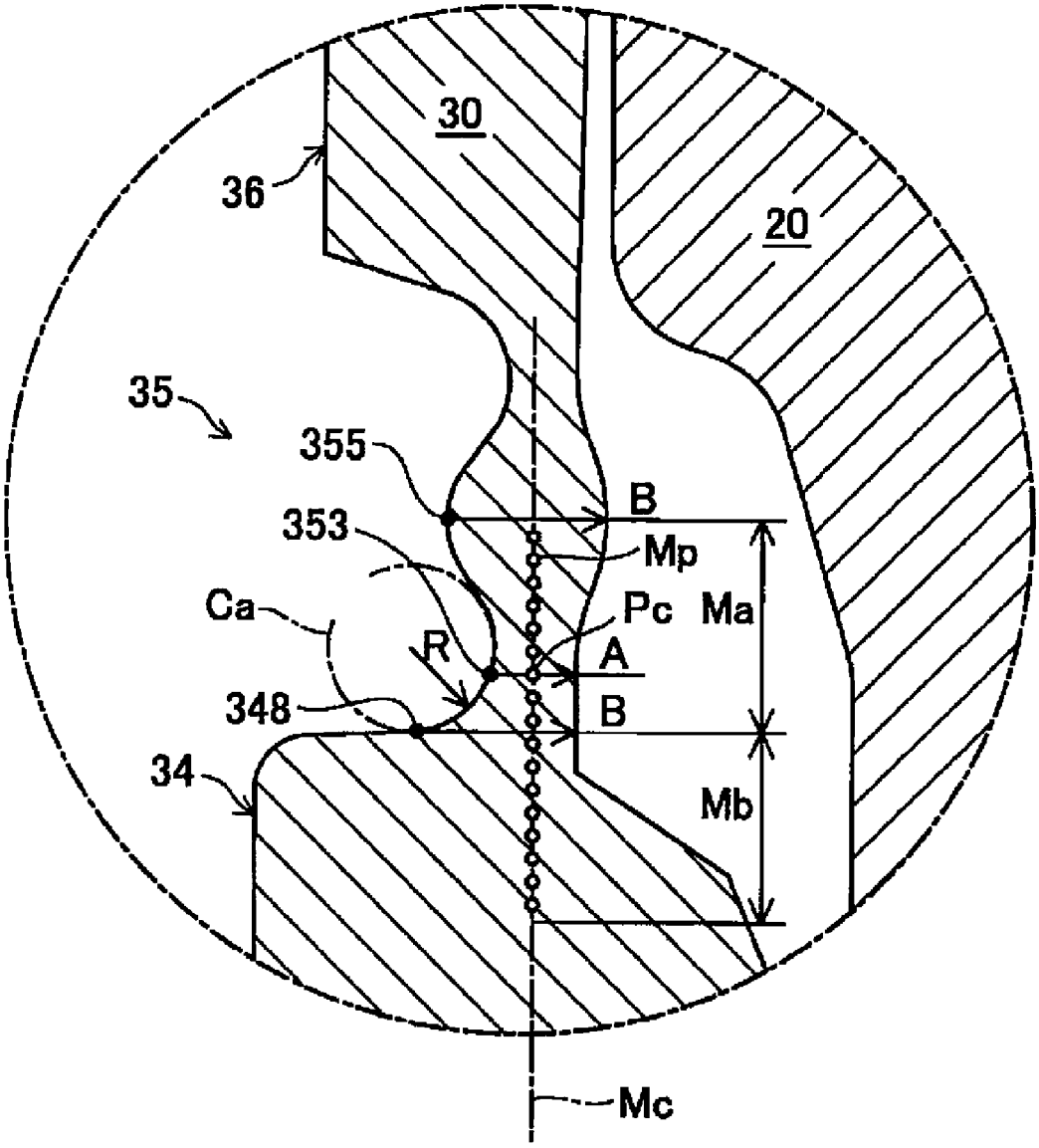
FIG. 2 is an enlarged sectional view enlarging and illustrating a portion of the metal shell.

FIG. 2 is an enlarged sectional view enlarging and illustrating a portion of the metal shell 30. The cross-section of the metal shell 30 shown in FIG. 2 is the cross-section that passes through the axis O-O. In other words, it is the cross-section including the axis O-O. FIG. 2 enlarges and illustrates the tool engaging section 36, the groove section 35 and the body section 34 of the metal shell 30. The body section 34 of the metal shell 30 includes an equal thickness section 348 and the groove section 35 of the metal shell 30 includes an inflection section 353 and an outermost section 355. The outermost section 355 of the groove section 35 is positioned at the center of the groove section 35 in the axis O-O direction and is a first section largest outer diameter. The inflection section 353 of the groove section 35 is a second section having a thickness in the radial direction through the body section 34 from the outermost section 355 of the groove section 35 that is the most thinned. The equal thickness section 348 of the body section 34 is a third section having a thickness in the radial direction that is the same as that of the outermost section 355 of the groove section 35 at the body section 34.

From the viewpoint of promoting an improvement in the breaking strength of the groove section 35 in the metal shell 30, at the cross-section of the metal shell 30 including the axis O-O, the relation between a thickness A of the inflection section 353 of the groove section 35 in the radial direction, and a radius of curvature R of the outer surface of the metal shell 30 that continues to the equal thickness section 348 of the body section 34 from the inflection section 353 of the groove section 35, preferably satisfies "$R \times A \geqq 0.20\ mm^2$" and the relation further preferably satisfies "$R \times A \geqq 0.21\ mm^2$". With respect to the shape of outer surface of the metal shell 30 that can capture a line segment which connects various circular arcs, the radius of curvature R is a radius of an approximation of circular arc Ca that is a single circular arc which approximates a shape in an area that connects the inflection section 353 and the equal thickness section 348 in the shapes of the outer surfaces of the metal shell 30. From the viewpoint of promoting a compact size of the spark plug 100, the thickness A of the inflection section 353 at the groove section 35 in the radial direction preferably satisfies $0.5\ mm \leqq A \leqq 0.8\ mm$, and the thickness A further preferably satisfies $0.5\ mm \leqq A \leqq 0.6\ mm$. The evaluation value regarding the radius of curvature R and the thickness A is described below.

From the viewpoint of suppressing the stress concentration at the groove section 35 of the metal shell 30, a relation between the thickness A of the inflection section 353 of the groove section 35 in the radial direction and a thickness B of the outermost section 355 of the groove section 35 in the radial direction preferably satisfies $0.6 \leqq (A/B) \leqq 1.0$. The evaluation value of the ratio (A/B) of the thickness of the groove section 35 in the radial direction is described below.

Figure 3:
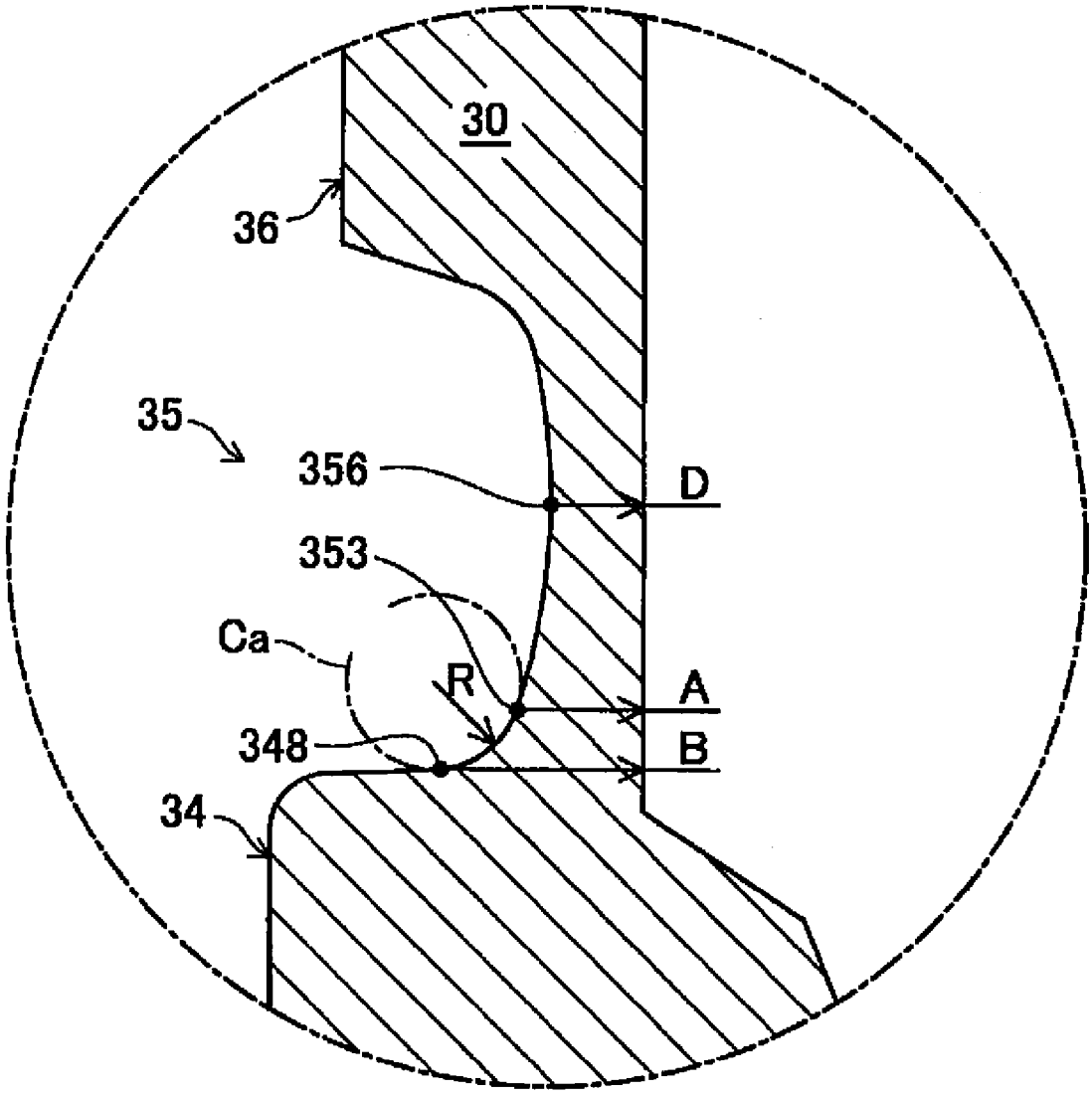
FIG. 3 is an enlarged sectional view enlarging and illustrating a portion of the metal shell before heat crimping.

FIG. 3 is an enlarged sectional view enlarging and illustrating a portion of the metal shell 30 before the heat crimping. The cross-section of the metal shell 30 shown in FIG. 3 is the cross-section passing through the axis O-O. In other words, it is the cross-section including the axis O-O. FIG. 3 enlarges and illustrates the tool engaging section 36, the groove section 35 and the body section 34 of the metal shell 30 prior to fixing the metal shell 30 to the insulator 20 by the heat crimping. In the embodiment, the groove section 35 of the metal shell 30 before the heat crimping includes a thin thickness section 356 where the thickness in the radial direction is thinnest at the groove section 35 at a portion where the outermost section 355 is formed by the heat crimping. The thin thickness section 356 of the groove section 35 bulges in the outer peripheral direction and in the inner peripheral direction by compression working in the heat crimping, and then becomes the outermost section 355. Since the thickness D of the thin thickness section 356 is thinner than the thickness A of the inflection section 353 and the thickness B of the equal thickness section 348, the influence of the heat is concentrated at the thin thickness section 356 in the heat crimping. Further, the bulge according to the compression working is prevented from reaching the inflection section 353 and the equal thickness section 348. Thus, in the embodiment, the radius of curvature R of the approximation of circular arc Ca that connects the inflection section 353 and the equal thickness section 348 is the same as before and after the heat crimping. Accordingly, the shape in the area that connects the inflection section 353 and the outermost section 355 of the shapes of the outer surfaces of the metal shell 30 can be formed in a relatively smooth curve. As a result, the breaking strength of the groove section 35 of the metal shell 30 may be improved.

In the metal shell 30 after the heat crimping, the hardness of the inflection section 353 of the groove section 35 is further decreased by influence of the heat of the heat crimping as compared to before the heat crimping. However, in the embodiment, since the breaking strength of the metal shell 30 is sufficiently secured, the Vickers hardness of the inflection section 353 of the groove section 35 may be lowered from that of the Vickers hardness of the body section 34 by 10% or more. A measuring method that measures the hardness of the body section 34 and the hardness of the groove section 35 is described below. In the measuring method of the hardness of the body section 34 and the hardness of the groove section 35, the metal shell 30 after the heat crimping is cut at a cross-section passing through the axis O-O and then the Vickers hardness is measured with a test load of 1.96 N (Newtons) at the cross-section of the metal shell 30 that is cut. As shown in FIG. 2, a plurality of measuring points Mp that are measurement targets of Vickers hardness are aligned with each other at intervals of 0.1 mm along a measuring reference line Mc parallel to the axis O-O that passes through a center point Pc of the thickness of the inflection section 353 in the radial direction. In the embodiment, the center point Pc is one of the measuring points Mp. Regarding the Vickers hardness of the body section 34, three measuring points Mp of the plurality of the measuring points Mp are selected, of which the hardness is low in the measuring range Mb from the equal thickness section 348 of the body section 34 to a portion that is 2 mm opposite the groove section 35, and then an average value of the hardness of three measuring points Mp is evaluated as the hardness of the body section 34. Regarding the Vickers hardness of the groove section 35, three measuring points Mp of a plurality of the measuring points Mp are selected, of which the hardness is low in the measuring range Ma from the equal thickness section 348 of the body section 34 to the outermost section 355 of the groove section 35, and then an average value of the hardness of three measuring points Mp is evaluated as the hardness of the groove section 35. Also, the distance of the measuring points Mp may be larger or smaller than 2 mm. Also, the number of the measuring points Mp used in evaluating the hardness is not limited to three, but may be two, or may be four or more. The evaluation value regarding the decreasing hardness of the groove section 35 is described below.

The hardness difference $\Delta Hv$ between the maximum value and the minimum value of the Vickers hardness in the measuring range Ma from the inflection section 353 to the outermost section 355 of the groove section 35 of the metal shell 30 may be $\Delta Hv \geqq 100$. The measuring method of the hardness difference ΔHv is described below. In the measuring method of the hardness difference ΔHv, the Vickers hardness is measured at a plurality of the measuring points Mp from the inflection section 353 to the outermost section 355 of the groove section 35 similar to the above described method of measuring the hardness of the body section 34 and the hardness of the groove section 35. Next, the difference between the maximum value and the minimum value of the hardness in a plurality of the measuring points Mp is evaluated as the hardness difference ΔHv. Also, each of the maximum value and the minimum value of the hardness from the inflection section 353 to the outermost section 355 of the groove section 35 may be the value of one measuring point Mp and may be an average value of a plurality of the measuring points Mp. The evaluation value of the hardness difference ΔHv at the groove section 35 is described below.

From the viewpoint of promoting a compact size of the spark plug 100, a section modulus Z1 about the axis O-O at the outermost section 355 of the groove section 35 is preferably $Z1 \leqq 170\ mm^3$, and a section modulus Z2 about the axis O-O at the inflection section 353 of the groove section 35 is preferably $Z2 \leqq 80\ mm^3$. The evaluation values of the section modulus Z1 and the section modulus Z2 are described below. Also, the section modulus Z1 is calculated on the basis of the following formula 1, and the section modulus Z2 is calculated on the basis of the following formula 2.

$$Z1=(\pi/32)\cdot[\{(d2)^4-(d1)^4\}/(d2)] \quad (1)$$

$$Z2=(\pi/32)\cdot[\{(d4)^4-(d3)^4\}/(d4)] \quad (2)$$

Herein, "d1" is the inner diameter of the outermost section 355, "d2" is the outer diameter of the outermost section 355 in the formula 1, "d3" is the inner diameter of the inflection section 353 and "d4" is the outer diameter of the inflection section 353 in the formula 2.

Figure 4A:
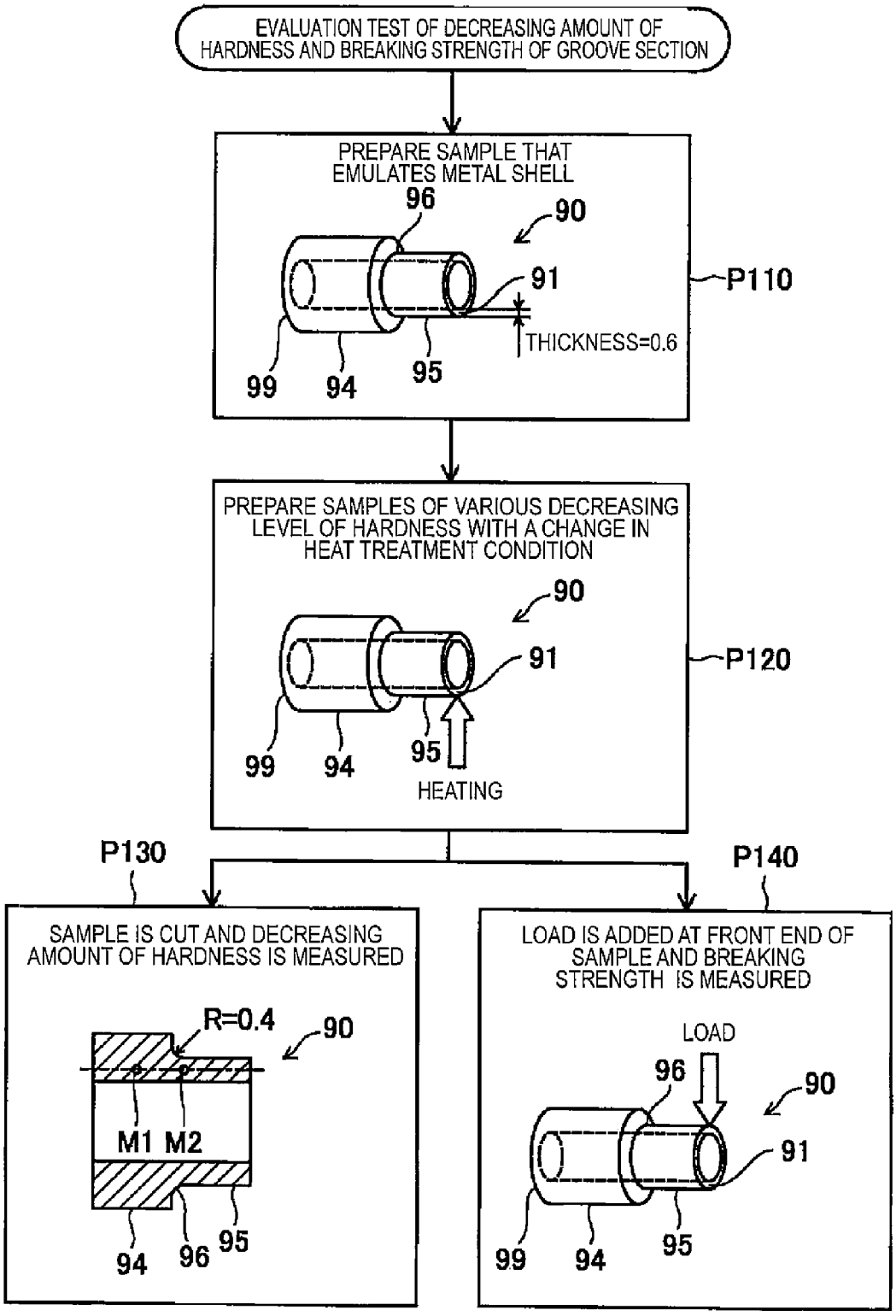
FIG. 4A is a process drawing of an evaluation test that evaluates a decrease in hardness and breaking strength of the groove section.

A-2. Evaluation Value of Decrease in Hardness of Groove Section:

FIG. 4A is a process drawing of an evaluation test that evaluates the decrease in hardness and the breaking strength of the groove section 35. In the evaluation test of FIG. 4A, first of all, a plurality of samples 90 that emulate the metal shell 30 is prepared (process P110). The samples 90 that are used in the evaluation test are hollow stepped round rods including a first cylindrical section 94 that emulates the body section 34 and a second cylindrical section 95 that emulates the groove section 35. In the samples 90 of the evaluation test, the thickness of the second cylindrical section 95 in the radial direction is 0.6 mm and the radius of curvature R of the outer surface at a connecting section 96 that connects the first cylindrical section 94 and the second cylindrical section 95 is 0.4 mm. Next, with respect to each of a plurality of the samples 90, the heat treatment condition is changed such that the hardness of the second cylindrical section 95 decreases by various amounts and an end section 91 of the second cylindrical section 95 side is heated (process P120). In the evaluation test, two samples 90 are treated using the same heat treatment condition, one sample 90 is used to measure the decreasing amount of hardness (process P130), and the other sample 90 is used to measure the breaking strength (process P140).

In measuring (process P130) the decrease in hardness, the samples 90 after heating are cut along the axial center and the Vickers hardness is measured with a test load of 1.96N (Newtons) at the cross-section of the samples 90 that were cut. The measuring points of the Vickers hardness include the measuring point M1 that measures the hardness of the first cylindrical section 94 and the measuring point M2 that measures the hardness of the second cylindrical section 95. The measuring points M1 and M2 are positioned on a straight line that is parallel to the axis of the sample 90 that passes through the center point of the thickness of the second cylindrical section 95 in the radial direction. The measuring point M1 corresponds to a position that is 2 mm to the first cylindrical section 94 side from the connecting section 96, and the measuring point M2 corresponds to a position where a circular arc of the connecting section 96 is cut at the second cylindrical section 95 side. In measuring the breaking strength (process P140), in a state where the samples 90 after heating are held at an end section 99 of the first cylindrical section 94 side, a load is added from a direction at right angles to the axis of the sample 90 with respect to the end section 91 of the second cylindrical section 95 side, and the breaking load that breaks the sample 90 at the connecting section 96 is measured.

Figure 4B:
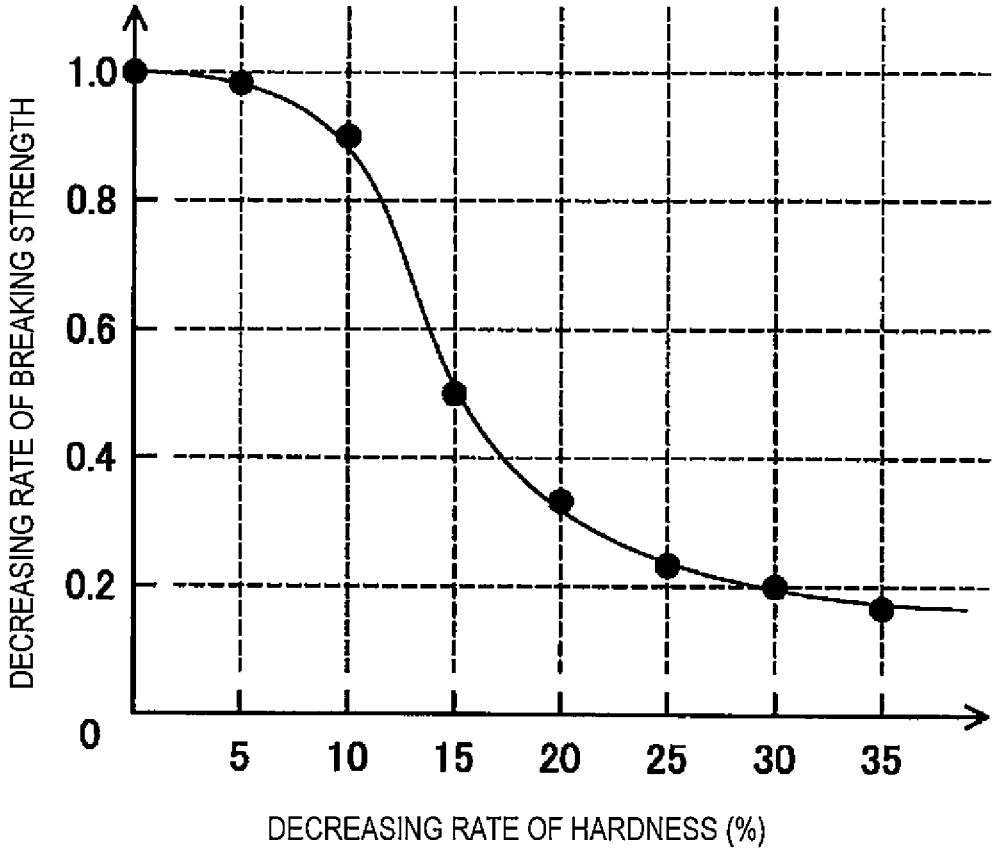
FIG. 4B is an explanatory drawing illustrating the relation between the amount of decrease in hardness and the rate of decrease in the breaking strength of the groove section as a result of the evaluation test of FIG. 4A.

FIG. 4B is an explanatory drawing illustrating a relation of the amount of decrease in hardness and the rate of decrease in the breaking strength of the groove section 35 as a result of the evaluation test of FIG. 4A. In FIG. 4B, the rate of decrease in the hardness of the groove section 35 is set on the horizontal axis. The rate of decrease in the breaking strength of the groove section 35 is set on the vertical axis so that the relation between the amount of decrease in hardness and the rate of decrease in the breaking strength of the groove section 35 is illustrated. The rate of decrease in the hardness of the groove section 35 that is set along the horizontal axis in FIG. 4B is calculated using the measured values of the measuring points M1 and M2 that are measured in measuring the amount of decrease in hardness (process P130). Also, the rate of decrease in hardness is a value illustrating as a percentage the rate of decrease in the hardness of the measuring point M2 with respect to the hardness of the measuring point M1. The rate of decrease in the breaking strength of the groove section 35 that is set on the vertical axis in FIG. 4B is a value on the basis of the breaking load that is measured in measuring the breaking strength (process P140). Also, the rate of decrease in the breaking strength is a value illustrating the ratio of each of breaking loads on the basis of the breaking load (1.0) when the amount of decrease in hardness is 0%.

As shown in FIG. 4B, the rate of decrease in the breaking strength stops at 0.97 when the rate of decrease in the hardness is 5%. However, the rate of decrease in the breaking strength becomes 0.90 when the rate of decrease in the hardness is 10%, the rate of decrease in the breaking strength becomes 0.50 when the rate of decrease in the hardness is 15%, and the rate of decrease in the breaking strength becomes 0.33 when the rate of decrease in the hardness is 20%. Furthermore, the rate of decrease in the breaking strength decreases to about 0.20 when the rate of decrease in the hardness exceeds 25%. Accordingly, a solution for improving the breaking strength of the metal shell 30 is effective when the hardness of the groove section 35 is lower than the hardness of the body section 34 by 10% or more, and yet more effective when the decrease in hardness of the groove section 35 becomes greater than 15% or more, 20% or more, and 25% or more.

A-3. Evaluation Value of Radius of Curvature R and Thickness A:

FIG. 5A is an explanatory drawing illustrating the results of the evaluation test that investigates the relation between a value of R×A and the impact resistance performance of the groove section 35 when the thickness A of the inflection section 353 is A=0.5 mm. FIG. 5B is a explanatory drawing illustrating the results of the evaluation test that investigates the relation between the value of R×A and the impact resistance performance of the groove section 35 when the thickness A of the inflection section 353 is A=0.6 mm. FIG. 5C is an explanatory drawing illustrating the results of the evaluation test that investigates the relation between the value of R×A and the impact resistance performance of the groove section 35 when the thickness A of the inflection section 353 is A=0.7 mm. FIG. 5D is a explanatory drawing illustrating the results of the evaluation test that investigates the relation between the value of R×A and the impact resistance performance of the groove section 35 when the thickness A of the inflection section 353 is A=0.8 mm. In the evaluation tests of FIG. 5A to FIG. 5D, a plurality of samples each having a radius of curvature R different from one another were prepared, and an impact resistance test of the samples was carried out according to JIS B8031 (2006 Dec. 20 version). Specifically, under room temperature and standard humidity conditions, after the samples were attached to an impact resistance tester and an impact was applied to the samples over a period of 60 minutes at a rate of 400 times per minute, the samples were then evaluated for the presence or absence of a crack at the cross-section where the groove section 35 of the metal shell 30 was cut. Also, in the evaluation tests of FIG. 5A to FIG. 5D, samples in which the hardness of the groove section 35 is 20% lower than the hardness of the body section 34 were used.

According to the evaluation test shown in FIG. 5A, the radius of curvature R is 0.50 mm or more when the thickness A=0.5 mm. In other words, when "R×A≧0.20 $mm^2$" is satisfied, the generation of a crack at the groove section 35 is suppressed. According to the evaluation test shown in FIG. 5B, the radius of curvature R is 0.35 mm or more when the thickness A=0.6 mm. In other words, when "R×A≧0.21 $mm^2$" is satisfied, the generation of a crack at the groove section 35 is suppressed. According to the evaluation test shown in FIG. 5C, the radius of curvature R is 0.30 mm or more when the thickness A=0.7 mm. In other words, when "R×A≧0.21 $mm^2$" is satisfied, the generation of a crack at the groove section 35 is suppressed. According to the evaluation test shown in FIG. 5D, the radius of curvature R is 0.25 mm or more when the thickness A=0.8 mm. In other words, when "R×A≧0.20 $mm^2$" is satisfied, the generation of a crack at the groove section 35 is suppressed.

From the test results of FIG. 5A to FIG. 5D, it is considered that the stress concentration is relieved with respect to the inflection section 353 of the groove section 35 having a hardness that is lowered by the heat crimping. This is because the thickness A of the inflection section 353 of the groove section 35 is further increased and the radius of curvature R of the outer surface, which continues to the inflection section 353 of the groove section 35 from the equal thickness section 348 of the body section 34, is further increased. Accordingly, from the viewpoint of promoting improvement of the breaking strength of the groove section 35 in the metal shell 30, the relation between the radius of curvature R and the thickness A preferably satisfies "R×A≧0.20 $mm^2$" and further preferably satisfies "R×A≧0.21 $mm^2$". From the viewpoint of promoting a compact size of the spark plug 100, the thickness A of the inflection section 353 at the groove section 35 in the radial direction preferably is 0.5 mm≦A≦0.8 mm and further preferably is 0.5 mm≦A≦0.6 mm.

Figure 6:
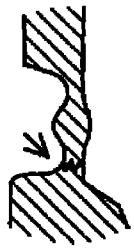
FIG. 6 is an explanatory drawing illustrating the results of an evaluation test that investigates the relation between the ratio A/B of the thickness of the groove section in the radial direction and the impact resistance performance of the groove section.
Figure 6:
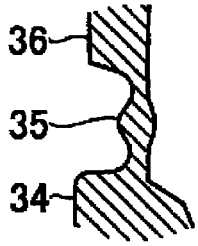
Figure 6:
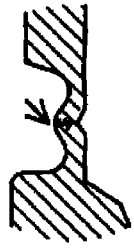

A-4. Evaluation Value of Ratio (A/B) of Thickness of Groove Section in Radial Direction:

FIG. 6 is a explanatory drawing illustrating the results of the evaluation test that investigates the relation between the ratio (A/B) of the thickness of the groove section 35 in the radial direction and the impact resistance performance of the groove section 35. In the evaluation test of FIG. 6, a plurality of samples was prepared, each having a ratio (A/B) of the thickness of the groove section 35 in the radial direction different from one another, and an impact resistance test of the samples was carried out according to JIS B8031 (2006 Dec. 20 version). Specifically, with respect to two samples having the same shape, under room temperature and standard humidity conditions, two samples were attached to the impact resistance tester, the impact was applied to one sample over a period of 60 minutes at a rate of 400 times per minute, and the impact was applied to the other sample over a period of 120 minutes at a rate of 400 times per minute. Then, the presence or absence of a crack was investigated at the cross-section where the groove section 35 of the metal shell 30 was cut. Also, in the evaluation test of FIG. 6, samples satisfying the relation "R×A≧0.20 $mm^2$" were used.

According to the evaluation test of FIG. 6, in the impact resistance test over a period of 60 minutes, no crack was generated at the groove section 35 of the metal shell 30 in all samples satisfying "(A/B)=0.4" to "(A/B)=1.3". Also, in the impact resistance test carried out over a period of 120 minutes, no crack was generated at the groove section 35 of the metal shell 30 in the samples satisfying "0.6≦(A/B)≦1.0". However, a crack was generated at the groove section 35 of the metal shell 30 in the samples where "(A/B)≦0.5" and "(A/B)≧1.1". In a case of "(A/B)≦0.5" according to the impact resistance test carried out over a period of 120 minutes, the portion of the generation of the crack corresponds to the inflection section 353 where the body section 34 and the groove section 35 are connected. In the case of "(A/B)≧1.1" according to the impact resistance test carried out over a period of 120 minutes, the portion of the generation of the crack is the center portion of the groove section 35 that corresponds to the position of the outermost section 355. In the case of "(A/B)≦0.5", in the result of the test of FIG. 6, it is considered that the stress concentration is generated excessively with respect to the inflection section 353. This is because the thickness A of the inflection section 353 is thinner than the thickness B of the outermost section 355. In the case of "(A/B)≧1.1", from the results of the test, it is considered that the stress is concentrated at the center portion of the groove section 35 that is thinner than the inflection section 353 where the groove section 35 bulges only in the outer peripheral direction. Accordingly, from the viewpoint of promoting the suppression of stress concentration at the groove section 35 of the metal shell 30, the relation between the thickness A of the inflection section 353 of the groove section 35 in the radial direction and the thickness B of the outermost section 355 of the groove section 35 in the radial direction preferably satisfies "0.6≦(A/B)≦1.0".

Figure 7:
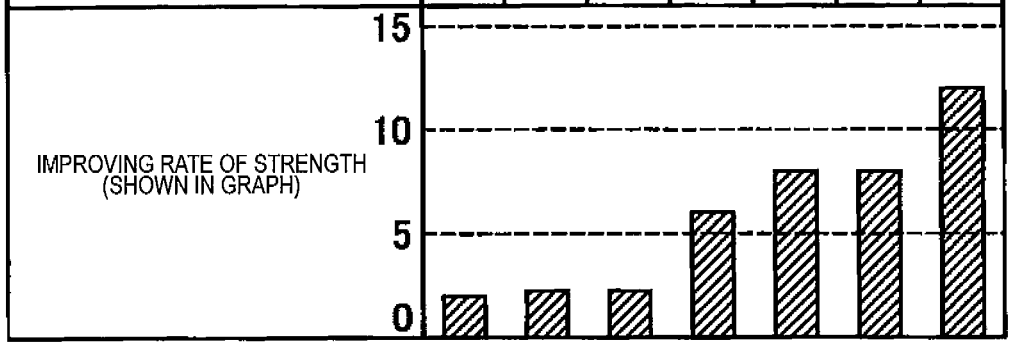
FIG. 7 is an explanatory drawing illustrating the results of an evaluation test that investigates the relation between the hardness difference ΔHv of the groove section and the impact resistance performance of the groove section.

A-5. Evaluation Value Regarding Hardness Difference ΔHv of Groove Section 35:

FIG. 7 is an explanatory drawing illustrating the result of the evaluation test that investigates the relation between the hardness difference ΔHv of the groove section 35 and the impact resistance performance of the groove section 35. In the evaluation test of FIG. 7, a plurality of differing samples was prepared having a hardness difference ΔHv of from 70 to 130 at the groove section 35, and an impact resistance test of the samples was carried out according to JIS B8031 (2006 Dec. 20 version). Specifically, under room temperature and standard humidity conditions, the samples were attached to an impact resistance tester, the samples were subjected to impact at a rate of 400 times per minute, and then the endurance time was measured until a crack generated at the groove section 35. Also, in the evaluation test of FIG. 7, the samples where "R×A=0.10" and "(A/B)=0.40", and the samples where "R×A=0.40" and (A/B)="0.70" were used.

According to the evaluation test of FIG. 7, in the samples where "R×A=0.10" and (A/B)="0.40", the hardness difference ΔHv decreases so that the endurance time increases. However, a crack was generated in 60 minutes even in the sample where "ΔHv=70". This result may be caused by a distortion that is generated at the groove section 35 due to the hardness difference decreasing the impact resistance. This is because the peripheral portion of the outermost section 355 assumes a quenching state during heat crimping and hardening, and then the peripheral portion of the inflection section 353 is softened by the influence of the heat when heat crimping. Also, in those samples where "R×A=0.40" and "(A/B)=0.70", even in the impact resistance test carried over a period of 120 minutes, no crack was generated in all samples having a hardness difference ΔHv from 70 to 130. Specifically, when the endurance time in the samples where "R×A=0.40" and "(A/B)=0.70" is compared to the endurance time in the samples where "R×A=0.10" and "(A/B)=0.40", the improvement rate of the endurance time rapidly increases by 6.0 times or more at "ΔHv=100", 8.0 times or more at "ΔHv=110" and "ΔHv=120", and 12.0 times or more at "ΔHv=130". Accordingly, a solution for improving the breaking strength of the metal shell 30 is effective when the hardness difference ΔHv of the groove section 35 is "ΔHv≧100", and increasingly more effective as the hardness difference ΔHv increases to "ΔHv≧110", "ΔHv≧120" and "ΔHv≧130".

Figure 8A:
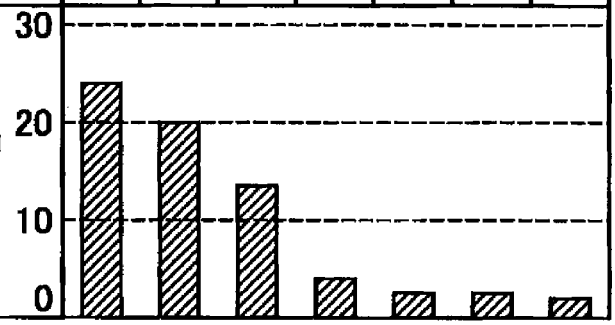
FIG. 8A is an explanatory drawing illustrating the results of an evaluation test that investigates the relation between the section modulus Z1 of the outermost section and the impact resistance performance of the groove section when the hardness difference of the groove section is ΔHv=100.
Figure 8B:
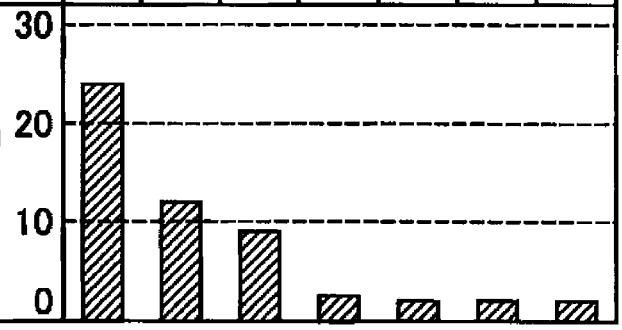
FIG. 8B is an explanatory drawing illustrating the results of an evaluation test that investigates the relation between the section modulus Z1 of the outermost section and the impact resistance performance of the groove section when the hardness difference of the groove section is ΔHv=200.
Figure 8C:
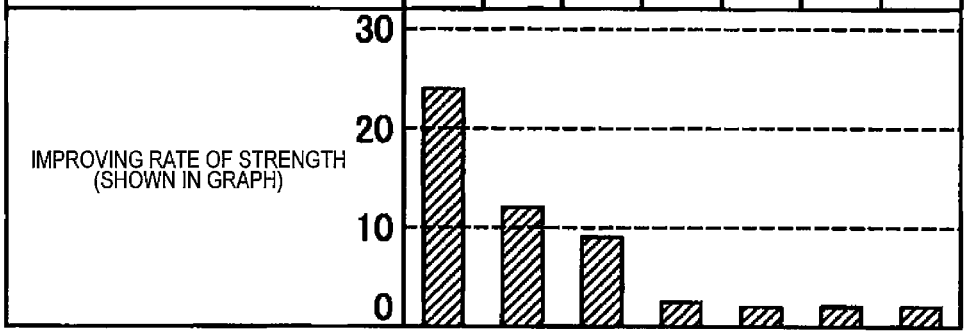
FIG. 8C is an explanatory drawing illustrating the results of an evaluation test that investigates the relation between a section modulus Z1 of the outermost section and the impact resistance performance of the groove section when the hardness difference of the groove section is ΔHv=300.

A-6. Evaluation Value of Section Modulus Z1 at the Outermost Section of Groove Section:

FIG. 8A is a explanatory drawing illustrating the results of the evaluation test that investigates the relation between the section modulus Z1 of the outermost section 355 and the impact resistance performance of the groove section 35 when the hardness difference of the groove section 35 is ΔHv=100. FIG. 8B is a explanatory drawing illustrating the results of the evaluation test that investigates the relation between the section modulus Z1 of the outermost section 355 and the impact resistance performance of the groove section 35 when the hardness difference of the groove section 35 is ΔHv=200. FIG. 8C is a explanatory drawing illustrating the results of the evaluation test that investigates the relation between a section modulus Z1 of the outermost section 355 and the impact resistance performance of the groove section 35 when the hardness difference of the groove section 35 is ΔHv=300. In the evaluation tests of FIG. 8A to FIG. 8C, a plurality of samples was prepared, each having a section modulus Z1 of the outermost section 355 differing from one another and ranging from 150 $mm^3$ to 210 $mm^3$, and an impact resistance test of the samples was carried out according to JIS B8031 (2006 Dec. 20 version). Specifically, under room temperature and standard humidity conditions, the samples were attached to an impact resistance tester, the samples were subjected to impact at a rate of 400 times per minute, and then the endurance time was measured until a crack generated at the groove section 35. Also, in the evaluation tests of FIG. 8A to FIG. 8C, the samples where "R×A=0.10" and "(A/B)=0.40", and the samples where "R×A=0.40" and "(A/B)=0.70" were used.

According to the evaluation tests of FIG. 8A to FIG. 8C, in the samples where "R×A=0.10" and "(A/B)=0.40", the section modulus Z1 of the outermost section 355 increased so that the endurance time became longer. However, a crack was generated even in the samples where "Z1=210 $mm^3$". This result may be due to decreasing stress at the groove section 35, while the section modulus Z1 of the outermost section 355 increases even in the case where the same impact momentum is received. Also, in the samples of "R×A=0.40" and "(A/B)=0.70", even in the 120 minute impact resistance test, no crack was generated in all samples having a section modulus Z1 of the outermost section 355 ranging from 150 $mm^3$ to 210 $mm^3$. Specifically, when the endurance time in the samples where "R×A=0.40" and "(A/B)=0.70" is compared to the endurance time in the samples where "R×A=0.10" and "(A/B)=0.40", the improvement rate of the endurance time rapidly increases by 6.0 times or more at "Z1=170 $mm^3$", 8.0 times or more at "Z1=160 $mm^3$", and 10.0 times or more at "Z1=150 $mm^3$". Accordingly, the solution for improving the breaking strength of the metal shell 30 is effective when the section modulus Z1 of the outermost section 355 is "Z1≦170 $mm^3$", and becomes more effective as the section modulus Z1 of the outermost section 355 decreases to "Z1≦160 $mm^3$" and "Z1≦150 $mm^3$".

Figure 9:
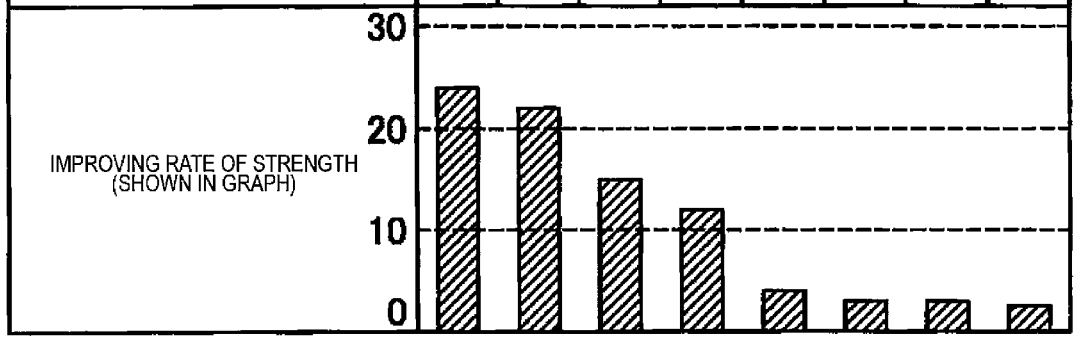
FIG. 9 is an explanatory drawing illustrating the results of an evaluation test that investigates the relation between the section modulus Z2 of the inflection section of the groove section and the impact resistance performance of the groove section.

A-7. Evaluation Value of Section Modulus Z1 at Inflection Section of Groove Section:

FIG. 9 is an explanatory drawing illustrating the results of the evaluation test that investigates the relation between the section modulus Z2 of the inflection section 353 of the groove section 35 and the impact resistance performance of the groove section 35. In the evaluation test of FIG. 9, a plurality of samples was prepared, differing in section modulus Z2 of the inflection section 353 from 50 $mm^3$ to 120 $mm^3$, and an impact resistance test of the samples was carried out according to JIS B8031 (2006 Dec. 20 version). Specifically, under room temperature and standard humidity conditions, the samples were attached to an impact resistance tester, the samples were subjected to impact at a rate of 400 times per minute, and then the endurance time was measured until a crack generated at the groove section 35. Also, in the evaluation test of FIG. 9, samples where "R×A=0.10" and samples where "R×A=0.40" were used.

According to the evaluation test of FIG. 9, in the samples where "R×A=0.10", the section modulus Z2 of the inflection section 353 increased so that the endurance time increased. However, a crack is generated even in samples where "Z2=120 $mm^3$". This result may be due to decreasing stress at the groove section 35 as the section modulus Z2 of the inflection section 353 increases even in the case where the same impact momentum is received. Also, in the samples where "R×A=0.20", even in the 120 minute impact resistance test, no crack was generated in all samples having a section modulus Z2 of the inflection section 353 ranging from 50 $mm^3$ to 120 $mm^3$. Specifically, when the endurance time in the samples where "R×A=0.20" is compared to the endurance time in the samples where "R×A=0.10", the improvement rate of the endurance time rapidly increased by 12.0 times or more at "Z2=80 $mm^3$", 15.0 times or more at "Z2=70 $mm^3$", 21.8 times or more at "Z2=60 $mm^3$" and 24.0 times or more at "Z2=50 $mm^3$". Accordingly, the solution for improving the breaking strength of the metal shell 30 is effective when the section modulus Z2 of the inflection section 353 is "Z2≦80 $mm^3$", and more effective when "Z2≦70 $mm^3$", and, even more effective as the section modulus Z2 of the inflection section 353 decreased to "Z2≦60 $mm^3$" and "Z2≦50 $mm^3$".

A-8. Advantage:

According to the above-described spark plug 100, "R×A≧0.20 $mm^2$" is satisfied so that the breaking strength of the groove section 35 of the metal shell 30 may be improved. Also, even in the metal shell 30 where the hardness of the groove section 35 is lower by 10% or more than the hardness of the body section 34, the breaking strength of the groove section 35 is capable of being sufficiently secured. Also, since the thickness A of the inflection section 353 of the groove section 35 in the radial direction is relatively thin and compact in size in a range of "0.5 mm≦A≦0.6 mm", the breaking strength of the groove section 35 of the metal shell 30 is capable of being sufficiently secured. Also, as to the ratio (A/B) of the thickness of the groove section 35 in the radial direction, "0.6≦(A/B)≦1.0" is satisfied so that the stress concentration at the groove section 35 of the metal shell 30 may be suppressed and the breaking strength of the groove section 35 is capable of further improvement. Also, even though the hardness difference ΔHv between the maximum value and the minimum value of the Vickers hardness in the range from the inflection section 353 to the outermost section 355 is 100 or more, the breaking strength of the groove section 35 is capable of being sufficiently secured. Also, since the section modulus Z1 of the most outer section 355 of the groove section 35 becomes compact in size to 170 $mm^3$ or less, the breaking strength of the groove section 35 of the metal shell 30 is capable of being sufficiently secured. Also, since the section modulus Z2 of the inflection section 353 at the groove section 35 becomes compact in size to 80 $mm^3$ or less, the breaking strength of the groove section 35 of the metal shell 30 is capable of being sufficiently secured.

Figure 10:
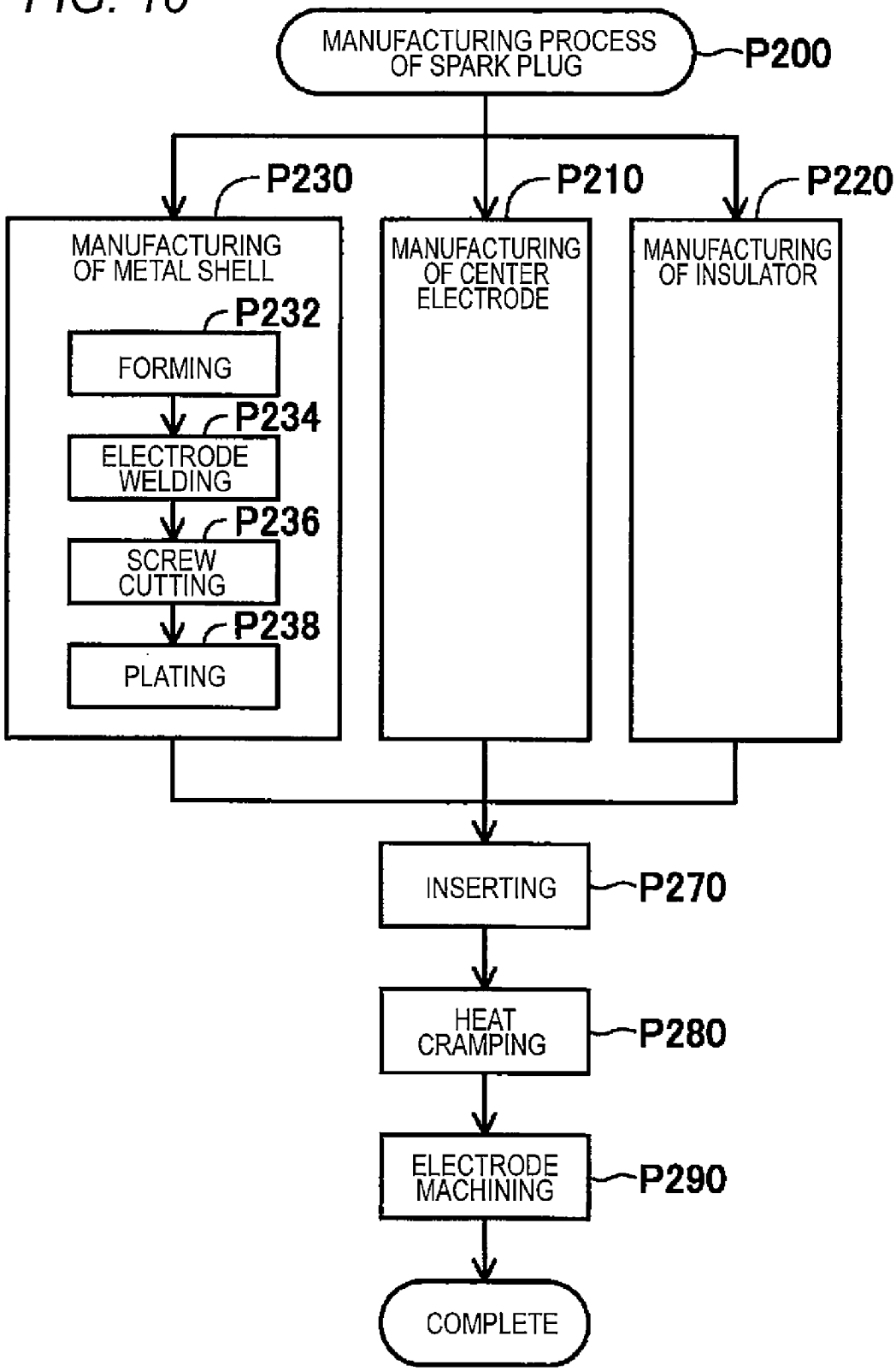
FIG. 10 is a process drawing illustrating a manufacturing process of the spark plug.

B-1. Manufacturing Method of Spark Plug:

FIG. 10 is a process drawing illustrating a manufacturing process P200 of the spark plug 100. In the manufacturing process P200 of the spark plug 100, first of all, each of the components which constitute the spark plug 100 such as the center electrode 10, the insulator 20 and the metal shell 30 is manufactured (process P210, P220 and P230).

In the manufacturing process P230 of the metal shell 30, the shape of the metal shell 30 is formed of cut mild steel material by compression working and cutting working (process P232). After that, the ground electrode 40 before bending is welded to the formed body of the mild steel material (process P234) and the attachment screw section 32 is rolled (process P236). After that, nickel plating and chromate processing are performed (process P238) and the metal shell 30 is completed.

After each of components that constitute the spark plug 100 is manufactured (processes P210, P220 and P230), the insulator 20 incorporating the center electrode 10 is inserted into the metal shell 30 (process P270).

After the insulator 20 is inserted into the metal shell 30 (process P270), the crimping section 38 of the metal shell 30 is heat crimped to the insulator 20 and then the metal shell 30 and the insulator 20 are assembled. At this time, the groove section 35 of the metal shell 30 has bulges which bulge in the outer peripheral direction and the inner peripheral direction.

After the metal shell 30 is heat crimped (process P280), when the ground electrode 40 is bent by the bending working and the spark gap is formed between the center electrode 10 and the ground electrode 40 (process P290), the spark plug 100 is completed.

Figure 11:
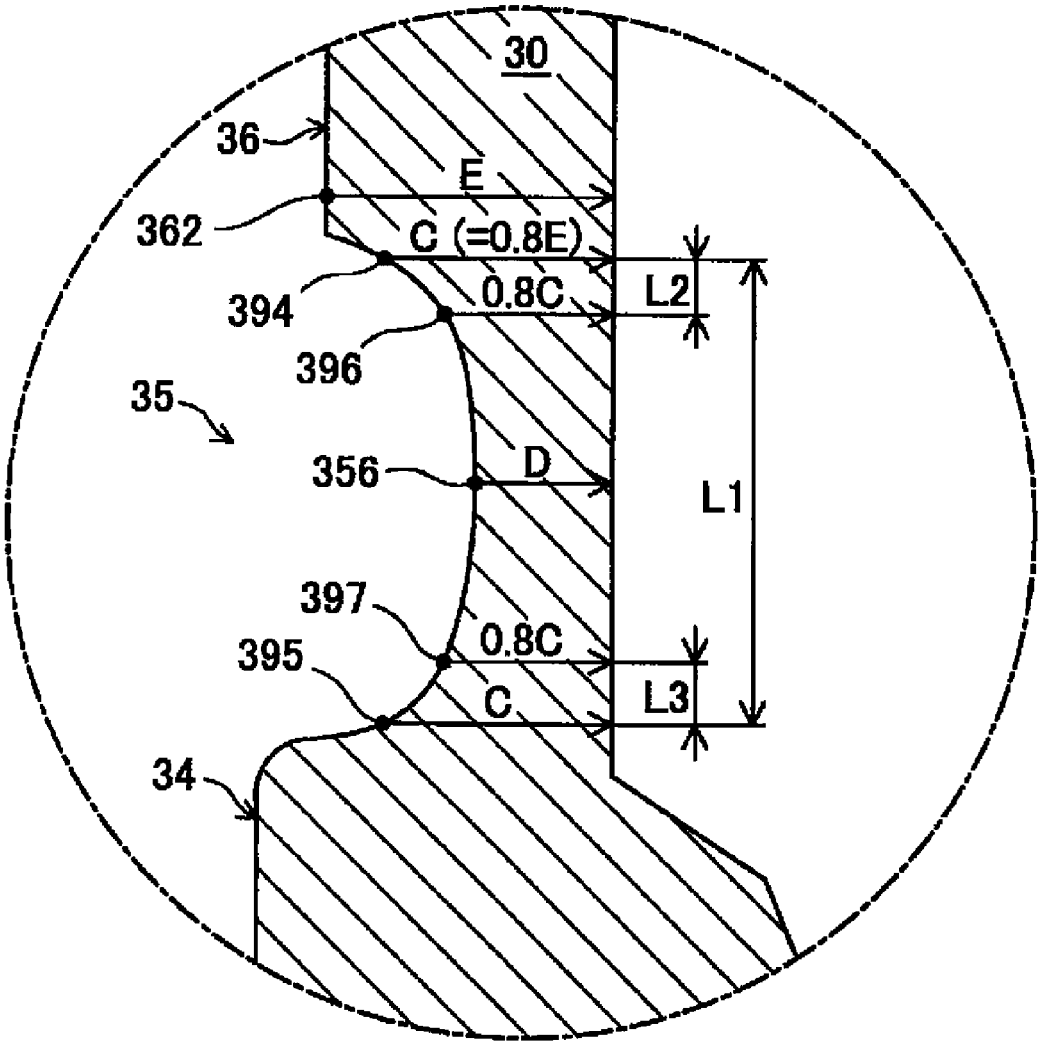
FIG. 11 is an enlarged sectional view enlarging and illustrating a portion of the metal shell before heat crimping.

FIG. 11 is an enlarged sectional view enlarging and illustrating a portion of the metal shell 30 before heat crimping. The cross-section of the metal shell 30 shown in FIG. 11 is the same as that of FIG. 3. As shown in FIG. 11, the groove section 35, before the bulge due to the heat crimping is formed, has a shape which is thinned toward the thin thickness section 356 that is the center of the groove section 35 from the tool engaging section 36 and the body section 34 in the radial direction. Accordingly, at the time of heat crimping, the groove section 35 having a smooth shape is susceptible to bulging, and the spark plug 100 where the breaking strength of the groove section 35 at the metal shell 30 is improved may be manufactured.

A thin thickness section 362 of the tool engaging section 36 is the thinnest portion of the tool engaging section 36 in the radial direction. A fourth section 394 of the groove section 35 is a portion having a thickness in the radial direction that is 80% the thickness E of the thin thickness section 362 of the tool engaging section 36 in the radial direction at the tool engaging section 36 side rather than the thin thickness section 356 of the groove section 35. A fifth section 395 of the groove section 35 has a thickness in the radial direction that is 80% the thickness E of the thin thickness section 362 of the tool engaging section 36 in the radial direction at the body section 34 side rather than the thin thickness section 356 of the groove section 35. As used herein, the thickness of the fourth section 394 and the fifth section 395 of the groove section 35 in radial direction is referred to as C.

A sixth section 396 of the groove section 35 is positioned between the thin thickness section 356 and the fourth section 394 and is a portion having a thickness in the radial direction that is 80% the thickness C of the fourth section 394 in the radial direction at the tool engaging section 36 side rather than the thin thickness section 356. A seventh section 397 of the groove section 35 is positioned between the thin thickness section 356 and the fifth section 395, and has a thickness in the radial direction that is 80% the thickness C of the fifth section 395 in the radial direction at the body section 34 side rather than the thin thickness section 356.

From the viewpoint of improving the breaking strength of the groove section 35 of the metal shell 30, while promoting the improvement of air tightness between the insulator 20 and the metal shell 30, the relation between the thickness C of the fourth section 394 and a thickness D of the thin thickness section 356 of the groove section 35 preferably satisfies "0.5≦(D/C)≦1.0" at the cross-section of the metal shell 30 including the axis O-O. The evaluation value of the ratio (D/C) of the thickness of the groove section 35 in the radial direction is described below.

From the viewpoint of improving the breaking strength of the groove section 35 of the metal shell 30, the relation between a distance L1 from the fourth section 394 to the fifth section 395 of the groove section 35 along the axis O-O and a distance L2 from the fourth section 394 to the sixth section 396 along the axis O-O satisfies "0.2≦(L2/L1)≦0.5" at the cross-section of the metal shell 30 including the axis O-O. The evaluation value of the ratio (L2/L1) of the length of the groove section 35 along the axis O-O is described below.

From the viewpoint of improving the breaking strength of the groove section 35 of the metal shell 30, the relation between the distance L1 from the fourth section 394 to the fifth section 395 of the groove section 35 along the axis O-O and a distance L3 from the fifth section 395 to the seventh section 397 along the axis O-O preferably satisfies "0.2≦(L3/L1)≦0.5" at the cross-section of the metal shell 30 including the axis O-O. The evaluation value of the ratio (L3/L1) of the length of the groove section 35 along the axis O-O is described below.

B-2. Evaluation Value of Ratio (D/C) of Thickness of Groove Section:

FIG. 12 is an explanatory drawing illustrating the results of the evaluation test that investigates the relation between the ratio (D/C) of the thickness and the air tightness performance of the groove section 35. In the evaluation test of FIG. 12, a plurality of the spark plugs 100 manufactured using the metal shells 30 of differing ratio (D/C) were prepared as samples, and evaluated in an air tightness test according to JIS B8031 (2006 Dec. 20 version). Specifically, the samples were exposed at an ambient temperature of 200° C. and an atmospheric pressure of 1.5 MPa, and the presence of absence of leakage at the crimping section 38 of the metal shell 30 was investigated. In the test, when the leakage amount is 1.0 ml/min or less, leakage was judged absent and when the leakage amount is over 1.0 ml/min, leakage was judged present.

According to the evaluation test of FIG. 12, when the ratio (D/C) is "0.3" or "0.4", leakage is generated at the crimping section 38 of the metal shell 30 and sufficient air tightness cannot be obtained. Meanwhile, when the ratio (D/C) is "0.5", "0.6", "0.7", "0.8", "0.9" or "1.0", sufficient air tightness can be obtained at the crimping section 38 of the metal shell 30.

In the test results of FIG. 12, when the ratio (D/C) is excessively small, leakage may result due to a high enough residual stress that is applied to the groove section 35 of the metal shell 30. This is because the influence of the heat is not applied to the body section 34 side and the tool engaging section 36 side of the groove section 35, and the groove section 35 cannot be adequately bulged at the time of heat crimping. Accordingly, from the viewpoint of improving the breaking strength of the groove section 35 of the metal shell 30, while promoting the improvement of air tightness between the insulator 20 and the metal shell 30, the ratio (D/C) of the thickness of the groove section 35 in the radial direction preferably satisfies "$0.5 \leqq (D/C) \leqq 1.0$".

B-3. Evaluation Value of Ratio (L2/L1) and (L3/L1) of Length of Groove Section:

FIG. 13 is an explanatory drawing illustrating the results of the evaluation test that investigates the relation between the ratio (L2/L1) and (L3/L1) of the length at the groove section 35, and the impact resistance performance of the groove section 35. In the evaluation test of FIG. 13, a plurality of the spark plugs 100, which were manufactured using various metal shells 30 having different ratios (L2/L1) and (L3/L1), were prepared and an impact resistance test of the samples was carried out according to JIS B8031 (2006 Dec. 20 version). Specifically, under room temperature and standard humidity conditions, the samples were attached to an impact resistance tester, the samples were subjected to impact over a period of 60 minutes at a rate of 400 times per minute and then evaluated for the presence or absence of a crack at the cross-section where the groove section 35 of the metal shell 30 was cut. Also, all ratios (D/C) of the thickness of the groove section 35 of the metal shell 30 used in the evaluation test of FIG. 13 were "0.7".

According to the evaluation test of FIG. 13, when at least one of the ratios (L2/L1) and (L3/L1) is "0.1", a crack is generated at the groove section 35 of the metal shell 30. Meanwhile, when the ratios (L2/L1) and (L3/L1) are "0.2", "0.3", "0.4" or "0.5", no crack is generated at the groove section 35 of the metal shell 30.

In the test result of FIG. 13, when the ratios (L2/L1) and (L3/L1) are excessively small, the above result may be due to stress concentration on the body section 34 side and the tool engaging section 36 side of the groove section 35. This is because the radius of curvature of the outer surface that continues from the groove section 35 to the body section 34 and the tool engaging section 36 after the bulging cannot be sufficiently secured. Accordingly, from the viewpoint of improving the breaking strength of the groove section 35 of the metal shell 30, the ratio (L2/L1) and (L3/L1) of the length of the groove section 35 preferably satisfies at least one of "$0.2 \leqq (L2/L1) \leqq 0.5$" and "$0.2 \leqq (L3/L1) \leqq 0.5$".

It should further be apparent to those skilled in the art that various changes in form and detail of the invention shown and described above may be made. It is intended that such changes be included within the spirit and scope of the claims appended hereto.

This application claims priority from Japanese Patent Application No. 2010-133775, filed on Jun. 11, 2010, and from Japanese Patent Application No. 2011-093977 filed on Apr. 20, 2011, the disclosures of which are incorporated herein by reference in their entirety.

What is claimed is:

1. A spark plug comprising:

a rod-shaped center electrode extending in an axial direction;

an insulator provided at an outer periphery of the center electrode; and a metal shell provided at an outer periphery of the insulator, the metal shell including:

a tool engaging section extending in an outer peripheral direction, wherein a cross-section of the tool engaging section crossing at right angles to the axial direction has a polygonal-shape;

a body section extending in the outer peripheral direction; and a groove section formed between the tool engaging section and the body section, and having bulges which bulge in the outer peripheral direction and in an inner peripheral direction, wherein, when a portion of the groove section having a largest outer diameter is a first section, a thinnest portion of the groove section in the radial direction from the first section to the body section is a second section, and a portion of the groove section having a thickness the same as that of the first section in the radial direction at the body section is a third section, wherein, at a cross-section including an axial center of the spark plug, a relation between a thickness A of the second section in the radial and a radius of curvature R of an outer surface of the metal shell that continues from the second section to the third section satisfies $R \times A \geqq 0.20$ $mm^2$.

2. The spark plug according to claim 1, wherein a Vickers hardness of the second section of the groove section is lower than a Vickers hardness of the body section by 10% or more.

3. The spark plug according to claim 1, wherein a section modulus Z2 of the second section is $Z2 \leqq 80$ $mm^3$.

4. The spark plug according to claim 3, wherein the section modulus Z2 of the second section is $Z2 \leqq 60$ $mm^3$.

5. The spark plug according to claim 1, wherein when a thickness of the first section in the radial direction is B, $0.6 \leqq (A/B) \leqq 1.0$ is satisfied.

6. The spark plug according to claim 1, wherein a hardness difference $\Delta Hv$ between the maximum value and the minimum value of a Vickers hardness over a range from the first section to the second section is $\Delta Hv \geqq 100$.

7. The spark plug according to claim 1, wherein a section modulus Z1 of the first section is $Z1 \leqq 170$ $mm^3$.

8. The spark plug according to claim 1, wherein $0.5\ mm \leqq A \leqq 0.6\ mm$.

9. A method of manufacturing a spark plug, the spark plug including:

a rod-shaped center electrode extending in an axial direction, an insulator provided at an outer periphery of the center electrode, and a metal shell provided at an outer periphery of the insulator, the metal shell including:

a tool engaging section extending in an outer peripheral direction, wherein a cross-section of the tool engaging section crossing at right angles to the axial direction has a polygonal-shape, a body section extending in the outer peripheral direction, and a groove section formed between the tool engaging section and the body section, and having bulges which bulge in the outer peripheral direction and in an inner peripheral direction, wherein, when a portion of the groove section having a largest outer diameter is a first section, a thinnest portion of the groove section in the radial direction from the first section to the body section is a second section, and a portion of the groove section having a thickness the same as that of the first section in the radial direction at the body section is a third section, wherein, at a cross-section including an axial center of the spark plug, a relation between a thickness A of the second section in the radial direction and a radius of curvature R of an outer surface of the metal shell that continues from the second section to the third section $R \times A \geqq 0.20\ mm^2$, the method comprising:

forming the groove section in a shape having a thickness that is thinned continuously from the tool engaging section and the body section to the center of the groove section in the radial direction before forming the bulges between the tool engaging section and the body section, prior to assembling the metal shell to the insulator, and then bulging the groove section in the outer peripheral direction and in the inner peripheral direction when the metal shell is joined to the insulator through heat crimping.

10. The method according to claim 9, wherein when a thickness that is 80% of the thinnest portion of the tool engaging section in the radial direction is C and the thickness in the radial direction of the center of the groove section before forming the bulges is D, the groove section before forming the bulges satisfies $0.5 \leqq (D/C) \leqq 1.0$.

11. The method according to claim 10, wherein when a distance along the axial direction from a fourth section where a thickness of the groove section before forming the bulges in the radial direction at the tool engaging section side is C, to a fifth section where a thickness of the groove section before forming the bulges in the radial direction at the body section side is C is L1, a distance along the axis direction between a sixth section where a thickness of the groove section before forming the bulges in the radial direction at the tool engaging section side is $(0.8 \times C)$ and the fourth section is L2, a distance along the axis direction between a seventh section where a thickness of the groove section before forming the bulges in the radial direction at the body section side is $(0.8 \times C)$ and the fifth section is L3, and the groove section before forming the bulges satisfies $0.2 \leqq (L2/L1) \leqq 0.5$ and $0.2 \leqq (L3/L1) \leqq 0.5$.

* * * * *